US008980056B2

(12) United States Patent
Lu et al.

(10) Patent No.: US 8,980,056 B2
(45) Date of Patent: Mar. 17, 2015

(54) COMPOSITION AND PROCESS FOR INCREASING THE DRY STRENGTH OF A PAPER PRODUCT

(75) Inventors: Chen Lu, Marietta, GA (US); Vladimir Grigoriev, Atlanta, GA (US); Scott Rosencrance, Douglasville, GA (US)

(73) Assignee: Kemira Oyj, Espoo (FI)

( * ) Notice: Subject to any disclaimer, the term of this patent is extended or adjusted under 35 U.S.C. 154(b) by 0 days.

(21) Appl. No.: 12/946,355

(22) Filed: Nov. 15, 2010

(65) Prior Publication Data

US 2012/0118523 A1 May 17, 2012

(51) Int. Cl.

| | |
|---|---|
| ***D21H 17/33*** | (2006.01) |
| ***D21H 21/18*** | (2006.01) |
| *D21H 17/29* | (2006.01) |
| *D21H 17/37* | (2006.01) |

(52) U.S. Cl.

CPC ..... *D21H 21/18* (2013.01); *D21H 17/29* (2013.01); *D21H 17/375* (2013.01)

USPC ..... 162/164.1; 162/164.3; 162/164.6; 162/168.1; 162/168.2; 162/168.3

(58) Field of Classification Search

USPC ..... 162/164.1–164.6

See application file for complete search history.

(56) References Cited

U.S. PATENT DOCUMENTS

| | | | | |
|---|---|---|---|---|
| 3,332,834 | A | 7/1967 | Reynolds, Jr. | |
| 4,066,495 | A | 1/1978 | Voigt et al. | |
| 4,824,523 | A * | 4/1989 | Wagberg et al. | 162/164.1 |
| 5,989,391 | A | 11/1999 | Watanabe et al. | |
| 6,294,645 | B1 * | 9/2001 | Allen et al. | 528/339.3 |
| 6,616,807 | B1 | 9/2003 | Dyllick-Brenzinger et al. | |
| 6,723,204 | B2 * | 4/2004 | Van Handel et al. | 162/183 |
| 2003/0188840 | A1 * | 10/2003 | Van Handel et al. | 162/164.1 |
| 2005/0155731 | A1 | 7/2005 | Martin et al. | |
| 2009/0120601 | A1 * | 5/2009 | Singh et al. | 162/164.3 |
| 2010/0186917 | A1 * | 7/2010 | Simonson et al. | 162/175 |

FOREIGN PATENT DOCUMENTS

| | | | |
|---|---|---|---|
| EP | 0227465 | | 7/1987 |
| EP | 0362770 | A2 | 4/1990 |
| WO | 9806898 | A1 | 2/1998 |
| WO | 2008049749 | A1 | 5/2008 |

OTHER PUBLICATIONS

International Search Report and Written Opinion dated Feb. 8, 2012.
International Preliminary Report on Patentability dated May 30, 2013.

* cited by examiner

*Primary Examiner* — Jacob Thomas Minskey
(74) *Attorney, Agent, or Firm* — Thomas Horstemeyer, LLP

(57) ABSTRACT

A dry strength additive composition generally includes an anionic and/or amphoteric polyacrylamide having a molecular weight of less than 1,000,000 Daltons, wherein the amphoteric polyacrylamide has a net negative charge; a cationic and/or amphoteric starch; and a cationic non-starch polymer having a charge density greater than 1 milliequivalent per gram (meq/g) at a pH of 3. The components defining the composition can be added to a pulp suspension sequentially or as a pre-blended mixture.

20 Claims, No Drawings

COMPOSITION AND PROCESS FOR INCREASING THE DRY STRENGTH OF A PAPER PRODUCT

BACKGROUND

The present disclosure generally relates to additive compositions and processes for increasing the dry strength of a paper product.

Paper strength is generally characterized by its dry and wet strength, among other properties. The dry strength property can be measured as a function of its tensile strength as a dry paper sheet, which is typically conditioned under uniform humidity and room temperature conditions prior to testing. The wet strength property can be measured as the tensile strength exhibited by the paper product that has been fully dried and then rewetted with water prior to testing.

For many paper products, high dry strength coupled with low wet strength are desired. For example, many bath tissue grades require good water dispersibility such that wet strength should be avoided. Furthermore, paper broke is often sent back to the pulper for repulping during the papermaking process and high wet strength can cause paper re-pulping difficulty.

To increase dry strength, paper manufacturers often add dry strength additive compositions during the papermaking process. Many of these additives are cationic polymers, which have been found to improve papermaking retention/drainage efficiency, which can provide an increased machine speed. For example, cationic starches are often added during the papermaking process to increase dry strength without increasing wet strength. However, to provide further gains in dry strength, much research work has been carried out to replace the cationic starches with novel dry strength polymeric resins that exhibit improved performance. One of the most studied dry strength resins is polyelectrolyte complexes containing a cationic polymer and an anionic polymer.

By way of example, U.S. Pat. No. 3,332,834 describes a dry strength system comprised of an anionic polyacrylamide, alum, and a water-soluble non-thermosetting cationic resin having a molecular weight between about 1000 and about 30,000.

U.S. Pat. No. 4,824,523 generally describes a method for manufacturing paper that includes the step of adding a dry-strength retention agent system to paper stock prior to forming the paper. The system includes from about 1% to about 7% by weight of a cationic starch having a degree of substitution between about 0.01 to about 0.035; an anionic polymer characterized as a copolymer of acrylamide with acrylic acid or 2-acrylamide 2-alkylpropane sulfonic acid, wherein the anionic polymer has an average molecular weight greater than one million; and a non-starch cationic synthetic polymer.

European Pat. No. 0362770 generally discloses that mixture of cationic and anionic polymers are useful as a strengthening additive in papermaking processes The cationic and anionic mixture is characterized in that it comprises a water-soluble, linear, cationic polymer having a reduced specific viscosity (0.05 weight % in a 2 M NaCl solution at 30° C.) greater than 2 dl/g and a charge density of 0.2 to 4 meq/g, and a water-soluble, anionic polymer having a charge density of less than 5 meq/g that is reactable in the presence of water with the cationic polymer to form a polyelectrolyte complex.

U.S. Pat. No. 6,723,204 generally describes a dry strength resin that is an aqueous mixture of anionic dry strength resin and cationic starch or amphoteric starch having a net cationic charge, wherein the ratio of the dry strength resin to cationic or amphoteric starch is such that the aqueous mixture has a net cationic charge.

U.S. Pat. No. 6,616,807 generally describes a process for the production of paper, board and cardboard that includes the addition of cationic, anionic or amphoteric starch as a dry strength agent to paper stock and drainage of the paper stock in the presence of retention aids with sheet formation, wherein one of the following is used as a retention aid for starch: polymers containing vinylamine units, polyethyleneimines, crosslinked polyamidoamines, ethyleneimine-grafted and crosslinked polyamidoamines, polydiallyldimethylammonium chlorides, polymers containing N-vinylimidazoline units, polymers containing dialkylaminoalkyl acrylate or dialkylaminoalkyl methacrylate, polymers containing dialkylaminoalkylacrylamide units or dialkylaminoalkylmethacrylamide units, and polyallylamines.

U.S. Pat. No. 6,294,645 generally describes a dry strength system for paper comprising a cationic component and an anionic component, wherein the cationic component comprises a reaction product of an intralinker and a polyamidoamine. The polyamidoamine prior to reacting with the intralinker has a reduced specific viscosity of less than about 0.125 dl/g, wherein the intralinker to amine is in a ratio of 0.10:1 to about 0.40:1 on a molar basis and wherein the intralinker is selected from the group consisting of epihalohydrins and diepoxides.

While prior art formulations may be adequate for use as a dry strength additive, there is a continuing need for a product that provides improved dry strength to a paper product without increasing wet strength.

BRIEF SUMMARY

Disclosed herein are compositions and processes for increasing dry strength. In one embodiment, a dry strength additive composition comprises an anionic and/or amphoteric polyacrylamide having a molecular weight of less than 1,000,000 Daltons, wherein the amphoteric polyacrylamide has a net negative charge; a cationic and/or amphoteric starch; and a cationic non-starch polymer having a charge density greater than 1 milliequivalents per gram (meq/g) at a pH of 3.

A process for increasing dry strength of a paper product comprises adding a composition comprising an anionic and/or amphoteric polyacrylamide having a molecular weight of less than 1,000,000 Daltons, wherein the amphoteric polyacrylamide has a net negative charge; a cationic and/or amphoteric starch; and a cationic non-starch polymer having a charge density greater than 1 meq/g at a pH of 3 to a pulp suspension; and forming the paper product.

The disclosure may be understood more readily by reference to the following detailed description of the various features of the disclosure and the examples included therein.

DETAILED DESCRIPTION

The present invention is generally directed to processes and compositions for increasing the dry strength properties of a paper product. The compositions generally include, in combination, an aqueous mixture of an anionic polyacrylamide and/or an amphoteric polyacrylamide having a net negative charge, wherein the polyacrylamide has a weight average molecular weight of less than 1 million Daltons; a cationic starch and/or an amphoteric starch; and a cationic non-starch polymer having a charge density greater than 1 milliequivalents per gram (meq/g) at a pH of 3. The process generally includes adding the above three components to a pulp slurry (i.e., pulp suspension) of a papermaking process as a premixed blend, or sequentially, without limitation as to order of addition. Applicants have advantageously discovered that the resulting paper product exhibits increased dry strength and unexpected improvements in drainage efficiency as will be described in greater detail below.

As noted above, the aqueous mixture includes an anionic polyacrylamide and/or an amphoteric polyacrylamide having a net negative charge. The anionic and/or amphoteric polyacrylamides may be crosslinked or non-crosslinked, linear or branched, or the like provided that the amphoteric polyacrylamide, when present, has a net negative charge at a pH of 7.

Suitable anionic polyacrylamides are not intended to be limited and generally include, without limitation, reaction products obtained by copolymerizing acrylamide with one or more anionic monomers (e.g., α,β-unsaturated carboxylic acids such as acrylic acid, methacrylic acid, itaconic acid, and the like, and salts thereof, or 2-acrylamido-2-methylpropane sulfonic acid and the like, and salts thereof, or styrene sulfonic acid and the like, and salts thereof, or vinylsulfonic acid and the like, and salts thereof), a partially hydrolyzed product of polyacrylamide, and the like. In one embodiment, the anionic monomer is less than 90 mole percent; and in other embodiments, the anionic monomer is less than 70 mole percent and in still other embodiments, the anionic monomer is less than 40 mole percent of the anionic polyacrylamide.

The amphoteric polyacrylamide generally includes, without limitation, copolymers of acrylamide with the anionic monomers as described above and a cationic monomer with the proviso that the amphoteric polyacrylamide has a net negative charge. Suitable cationic monomers include unsaturated monomers containing amino groups or quaternary amino groups, e.g., diallyldimethyl ammonium chloride, vinyl amine, 2-vinylpyridine, 2-vinyl-N-methylpyridinium chloride, (p-vinylphenyl) trimethyl ammonium chloride, allylamine, trimethyl(p-vinylbenzyl)ammonium chloride, p-dimethylaminoethylstyrene, trialkylaminoalkyl acrylate, trialkylaminoalkyl methacrylate, dialkylaminoalkyl acrylate, dialkylaminoalkyl methacrylate, trialkylaminoalkyl acrylamide, trialkylaminoalkyl methacrylamide, dialkylaminoalkyl acrylamide, dialkylaminoalkyl methacrylamide, and the like, wherein the alkyl group contains from one to seven carbon atoms When monomers containing amino groups are used, cationic sites can be obtained by forming salts of the amino groups with mineral or organic acids. In one embodiment, the amphoteric polymers for use in the invention will have an amount of anionic monomer plus cationic monomer that is less than 90% mole percent, preferably less than about 70% mole percent, and more preferably less than about 40% mole percent, of the total of anionic, cationic and nonionic monomers.

In most embodiments, the anionic and/or amphoteric polyacrylamide has a weight average molecular weight of less than 1,000,000 Daltons, and in still other embodiments, the anionic and/or amphoteric polyacrylamide has a weight average molecular weight of less than 500,000 Daltons. The anionic and/or amphoteric polyacrylamide is generally about 5 to about 90 percent by weight based on a total dry weight of composition. In other embodiments, the anionic and/or amphoteric polyacrylamide is about 20 to about 80 percent by dry weight; and in still other embodiments, the anionic and/or amphoteric polyacrylamide is about 30 to about 70 percent by weight of the total dry weight of the composition.

The starches for use in the invention are cationic and/or amphoteric starches, which are readily available by derivatization of starch. When amphoteric starch is used, it is generally preferred that the starch has a net positive charge. Examples of suitable cationic and/or amphoteric starches that can be used include, without limitation, corn, waxy maize, potato, wheat, tapioca, or rice starches, or the like. For most applications, the starch (cationic or amphoteric) has a degree of cationic substitution (DS) of 0.001 to 0.5%. In other applications, the cationic and/or amphoteric starch has a DS of 0.03 to 0.4%; and in still other applications, the starch has a DS of 0.04 to 0.3. The cationic and/or amphoteric starch is generally about 5 to about 90 percent by weight based on a total weight of composition. In other embodiments, the cationic and/or amphoteric starch is about 20 to about 80 percent by weight; and in still other embodiments, the cationic and/or amphoteric starch is about 30 to about 70 percent by weight of the total weight of the composition.

The cationic non-starch polymer is not intended to be limited so long as the cationic non-starch polymer has a charge density greater than about 1 milliequivalent per gram (meq/g) dry basis at a pH of 3. In other embodiments, the charge density of the cationic non-starch polymer is greater than 1 to about 24 meq/g dry basis. The charge density may be determined in accordance with conventional charge titration methods known by those of ordinary skill in the art. Exemplary cationic non-starch polymers include, without limitation, dimethylamine-ethylene diamine-epichlorohydrin polymers, dimethylamine-epichlorohydrin polymers, dimethyldiallylammonium chloride homopolymers and copolymers, cationic polymers containing amidine, polyamidoamine-epichlorohydrin polymers, polymers containing vinylamine units, polyethyleneimines, crosslinked polyamidoamines, ethyleneimine-grafted and crosslinked polyamidoamines, polymers containing N-vinylimidazoline units, polymers containing dialkylaminoalkyl acrylate or dialkylaminoalkyl methacrylate, polymers containing trialkylaminoalkyl acrylate or trialkylaminoalkyl methacrylate, polymers containing dialkylaminoalkylacrylamide units or dialkylaminoalkylmethacrylamide units, polymers containing trialkylaminoalkylacrylamide units or trialkylaminoalkylmethacrylamide units, and polyallylamines, ionene polymers or polymeric quaternary ammonium compounds (polyquats), i.e., cationic polymers containing quaternary nitrogens in the polymer backbone (also known as polymeric quats or polyquats). Mixtures comprising two or more of the above-identified polymers may also be utilized. The cationic non-starch polymer for use in the present invention may be linear or branched and have some level of water solubility. Generally, the cationic non-starch polymers may be made according to any conventional method known within the art.

In most embodiments, suitable cationic non-starch polymers include those having a weight average molecular weight in a range from about 200 to about 30 million Daltons, preferably from about 500 to about 5 million Daltons, more preferably from about 1000 to about 1 million Daltons. The cationic non-starch polymer is generally about 3 to about 70 percent by weight based on a total weight of composition. In other embodiments, the cationic non-starch polymers is about 5 to about 60 percent by weight; and in still other embodiments, the cationic non-starch polymers is about 7 to about 50 percent by weight of the total weight of the composition.

The composition can be added as a premixed blend or sequentially to the pulp slurry such that the composition is up to about 2 weight percent of the dry fiber. In one embodiment, the composition including the various components has an overall net positive charge. The pH of the pulp slurry is between about 4 to about 9.

The weight ratio of the polyacrylamide to starch is from 5:1 to 1:5, preferably from 3:1 to about 1:3, more preferably from 2:1 to about 1:2. By using the mixture of cationic starch and a high charge density cationic polymer as the cationic fixing aid, the anionic polyacrylamide content in the product remained relatively high. As a result, significant cost savings can be realized from the lower dosages of cationic starch. The weight ratio of starch to non-starch cationic polymer is from 10:1 to 1:5, preferably from 10:1 to about 1:2, more preferably from 5:1 to about 1:1.

Preparation of the composition can be carried out in a variety of ways. The composition can be mixed with adequate agitation and the mixture pumped to the paper machine. There is no requirement for an "aging time" for the mixture before it reaches the paper stock addition point. Alternatively, it is also possible to mix the components of the composition in the desired amounts and then prepare an aqueous solution of the mixture, which is then fed to the pulp slurry. In other embodiments, each component, without regard to order, can be added sequentially to the pulp slurry.

The invention described herein can be applied to processes for making any type of paper or paper board using any type of paper or paper board making machine. Examples are tissue, towel, napkin and other sanitary papers, printing and printing and writing papers, coated papers, publication papers, artist papers, bond and archival papers, super calendered wood-free grades, telephone directory paper, newsprint, text and cover papers, sack paper, gypsum paper, bristols, tag and file folder, linerboard, corrugating medium, coated unbleached and bleached kraft boards, recycled coated and uncoated boxboards, core stock, mat board, molded pulp products, ceiling tile, and insulation board. All these grades can benefit by having higher strength development and are made using a wet forming process in which a fibrous slurry is formed into a mat.

The pulp fibers used in manufacturing the above listed grades of paper or paper board may be used in the process of the invention. Suitable pulp fibers generally include, without limitation, bleached and unbleached kraft pulp suspensions, bleached and unbleached sulfite pulp suspensions, thermomechanical, chemithermomechanical, and mechanical pulp suspensions, groundwood pulp suspensions, recycled pulp suspensions, and virgin pulp suspensions.

The paper products produced according to the invention may also contain auxiliary materials that can be incorporated into the paper product by addition to the pulp at the wet end, directly to the paper product, or to a liquid medium used to impregnate the paper product. Representative materials include defoamers, bacteriocides, pigments, fillers, permanent wet strength resins, temporary wet strength resins, debonders, softeners, retention aids, wetting aids, enzymes, optical brightening additives, dyes, sizing additives, pitch fixatives, and the like.

The disclosure is further illustrated by the following non-limiting examples. In the following examples, the polyamine was prepared by reacting dimethylamine, ethylene diamine, and epichlorohydrin in a glass vessel equipped with an overhead agitator to obtain a solid content of 50% and a Brookfield viscosity measurement of 300 centipoise (cps) at about 21° C. Three cationic starches with different degrees of cationic substitution were obtained from Kemira Chemicals. Cationic starch-1 had a degree of cationic substitution of 0.04. Cationic starch-2 also had a degree of cationic substitution of 0.04. Cationic starch-3 had a degree of cationic substitution of 0.15. Three polyacrylamides were obtained from Kemira Chemicals. Polyacrylamide-1 was an anionic polyacrylamide with 8 mole percent sodium acrylate and a weight average molecular weight of about 200,000 Daltons. Polyacrylamide-2 was a high molecular weight anionic polyacrylamide with 10 mole percent sodium acrylate and a weight average molecular weight of about 1.6 million Daltons. Polyacrylamide-3 was a high molecular weight anionic polyacrylamide with 10 mole percent sodium acrylate and a weight average molecular weight of about 2 million Daltons.

EXAMPLES

In this example, the dry tensile strength of handsheets was measured after formation from a pulp suspension treated with premixed blends of the composition in accordance with the present invention. The dry strength of these handsheets was compared to handsheets formed from pulp suspensions using prior art additive blends as well as a control that was free of any additives.

The pulp suspensions included two virgin pulp suspensions (I) and (II) and two recycled pulp suspensions (I) and (II) obtained from different paper manufacturing facilities. Virgin pulp suspension (I) was prepared by mixing 50% by weight bleached hardwood (450 mls CSF) and 50% by weight bleached softwood (450 mls CSF). Virgin pulp suspension (II) was prepared by mixing 50% by weight bleached hardwood (650 mls CSF) and 50% by weight bleached softwood (650 mls CSF). Recycled pulp suspension (I) was a recycled pulp suspension obtained from a Midwest paper manufacturer and recycled pulp suspension (II) was a recycled pulp suspension obtained from a Southeast paper manufacturer. The pulp suspensions were diluted with deionized water to 0.5% solids and the pH adjusted to 7. Sodium sulfate was added to adjust the pulp conductance to 170 μS.

Examples 1-5 were prepared by mixing the polyamine, cationic starch, and water in a glass vessel equipped with an overhead agitator. The anionic polyacrylamide was then slowly added followed by the addition of sulfuric acid to lower the pH to 2.8. In Example 4, the composition further included 0.8% acetic acid as a buffer with a final pH of 2.8. The premixed dry strength additive compositions are provided in Table 1 below.

TABLE 1

PREMIXED DRY STRENGTH ADDITIVE COMPOSITIONS

| EXAMPLE NO. | POLYACRYLAMIDE (% by wt) | STARCH (% by wt) | CATIONIC NON-STARCH POLYMER (% by wt) |
|---|---|---|---|
| 1 | Anionic polyacrylamide-1 (10%) | Cationic starch-3, (5%) | Polyamine (5%) |
| 2 | Anionic polyacrylamide-1 (10%) | Cationic starch-3, (7%) | Polyamine (3%) |
| 3 | Anionic polyacrylamide-1 (10%) | Cationic starch-3, (10%) | Polyamine (3%) |
| 4 | Anionic polyacrylamide-1 (10%) | Cationic starch-3, (7%) | Polyamine (3%) |
| 5 | Anionic polyacrylamide-1 (10%) | Cationic starch-1, (7%) | Polyamine (3%) |

Examples 6 and 7 represented sequential addition to the pulp suspension of the individual components defining the dry strength additive composition. The total dosages of the dry strength additive composition to the respective pulp suspension were 12 lb/ton. The order of addition is shown in Table 2 below, wherein the first component (1) was added first to the pulp suspension followed by sequential addition of components (2) and (3), respectively.

TABLE 2

| ORDER OF ADDITION | |
|---|---|
| EXAMPLE NO. | ORDER OF ADDITION TO THE PULP SUSPENSION |
| 6 | 1. Anionic polyacrylamide-1 (6 lb/ton);<br>2. Cationic Starch-3 (4.2 lb/ton);<br>3. Polyamine (1.8 lb/ton) |
| 7 | 1. Cationic Starch-3 (4.2 lb/ton);<br>2. Polyamine (1.8 lb/ton);<br>3. Anionic polyacrylamide-1 (6 lb/ton) |

In Comparative Examples 1-3, the premixed blends consisted of the cationic starches only with differing degrees of substitution (DS), wherein Comparative Example 1 consisted of cationic starch-1; Comparative Example 2 consisted of cationic starch-2; and Comparative Example 3 consisted of cationic starch-3. Comparative Example 4 was a blend consisting of the polyamine and the polyacrylamide, which was prepared by first mixing the polyamine with water followed by slow addition of the polyacrylamide. Sulfuric acid was then added to lower the pH to 2.8. The various comparative compositions are shown in Table 3.

TABLE 3

| PREMIXED DRY STRENGTH ADDITIVE COMPOSITIONS | | | |
|---|---|---|---|
| EXAMPLE NO. | POLYACRYLAMIDE (% by wt) | STARCH | CATIONIC NON-STARCH POLYMER (% by wt) |
| 1* | — | Cationic starch-1 | — |
| 2* | — | Cationic starch-2 | — |
| 3* | — | Cationic starch-3 | — |
| 4* | 12% anionic polyacrylamide-1 | — | 8% polyamine |

*denotes comparative example

Comparative examples 5, 6, 7, and 8 represented sequential addition of the individual components defining the dry strength additive composition. The total dosages of the dry strength to the respective pulp suspension were 12 lb/ton. The order of addition is shown in Table 4 below, wherein the first component (1) was added first to the pulp suspension followed by sequential addition of components 2 and 3, respectively.

TABLE 4

| ORDER OF ADDITION | |
|---|---|
| EXAMPLE NO. | ORDER OF ADDITION TO THE PULP SUSPENSION |
| 5* | 1. Anionic polyacrylamide-1 (1.0 lb/ton);<br>2. Cationic Starch-1 (11.0 lb/ton) |
| 6* | 1. Anionic polyacrylamide-1 (2.0 lb/ton);<br>2. Cationic Starch-1 (10.0 lb/ton) |
| 7* | 1. Anionic polyacrylamide-2 (6 lb/ton);<br>2. Cationic Starch-3 (4.2 lb/ton);<br>3. Polyamine (1.8 lb/ton) |

TABLE 4-continued

| ORDER OF ADDITION | |
|---|---|
| EXAMPLE NO. | ORDER OF ADDITION TO THE PULP SUSPENSION |
| 8* | 1. Anionic polyacrylamide-3 (6 lb/ton);<br>2. Cationic Starch-3 (4.2 lb/ton);<br>3. Polyamine (1.8 lb/ton) |

*denotes comparative example

Handsheets were prepared from pulp suspensions including the various dry strength additive compositions set forth in Examples 1-7 and Comparative Examples 1-8 using a Noble and Wood Handsheet Mold (8 in×8 in), an Adirondack Press (15 psi), and an Adirondack Drum Dryer (240° F. +/−3° F.). In each instance, the dosages of the various dry strength additive compositions to the pulp suspension were at 12 pounds per ton (lb/ton). Control handsheets containing no additives were also prepared. The conductance of the water used for handsheet preparation was adjusted to about 220 μS by adding 75 ppm sulfate ions (sodium sulfate) and 15 ppm calcium ions (calcium chloride) to the deionized water. The prepared handsheets were conditioned in controlled environment room at 50% relative humidity and 23° C. overnight.

Dry tensile breaking strength of the handsheets was measured in accordance with Tappi standard method T494. The results for the composition in different pulp suspensions are provided in Tables 5, 6, 7, and 8. The dry tensile breaking strength results were normalized based on the basis weight of the handsheet.

TABLE 5

| HANDSHEET-RECYCLED PULP SUSPENSION (I) | |
|---|---|
| Example No. | DRY TENSILE BREAKING STRENGTH (lb/in) |
| Control | 11.2 |
| 1 | 13.9 |
| 2 | 13.8 |
| 3 | 14.1 |
| 4 | 14.4 |
| 5 | 12.9 |
| 1* | 12.5 |
| 4* | 12.2 |

*denotes comparable example

TABLE 6

| HANDSHEET-RECYCLED PULP SUSPENSION (II) | |
|---|---|
| Example No. | DRY TENSILE BREAKING STRENGTH (lb/in) |
| Control | 18.0 |
| 1 | 21.8 |
| 2 | 22.0 |
| 3 | 20.2 |
| 4 | 21.9 |
| 5 | 20.8 |
| 2* | 20.4 |
| 4* | 20.5 |

*denotes comparable example

TABLE 7

| HANDSHEET-VIRGIN PULP SUSPENSION (I) | |
|---|---|
| Example No. | DRY TENSILE BREAKING STRENGTH (lb/in) |
| Control | 23.0 |
| 4 | 30.4 |
| 6 | 30.4 |
| 7 | 29.0 |
| 2* | 27.8 |
| 3* | 26.4 |
| 5* | 27.8 |
| 6* | 29.0 |

*denotes comparable example

TABLE 8

| HANDSHEET-VIRGIN PULP SUSPENSION (II) | |
|---|---|
| Example No. | DRY TENSILE BREAKING STRENGTH (lb/in) |
| Control | 11.6 |
| 4 | 15.5 |
| 7* | 10.9 |
| 8* | 11.0 |

*denotes comparable example

The dry tensile breaking strength results clearly show that the blend of polyacrylamide, cationic starch, and polyamine in accordance with the invention when added to the different pulp suspensions consistently provided an increase in dry strength relative to the control (without any additives) and to the handsheets prepared with the cationic starch only (comparative examples 1-3) and to the handsheets prepared with the polyamine and anionic polyacrylamide blend (comparative example 4) and to the handsheets prepared with the sequentially added blends of cationic starch and anionic polyacrylamide (comparative examples 5 and 6) and to the handsheets prepared with the sequentially added blend of polyamine, cationic starch, and anionic polyacrylamide with a weight average molecular weight higher than one million Daltons (comparative examples 7 and 8).

Pulp dewatering tests were also carried out using recycled pulp suspension (I). In this test, 800 mL of the pulp suspension (1%) was added to a Britt Jar and agitated at 750 rpm. Then, 12 lb/ton of the dry strength composition was added and agitated for 10 seconds. Afterwards, agitation was stopped and the stock was left standing for 5 seconds before the collection of drainage water. The time of collecting 600 grams of drainage water was measured, wherein a lower drainage time indicated a faster dewatering rate. The results are shown in Table 8.

TABLE 8

| DRAINAGE EFFICIENCY | |
|---|---|
| EXAMPLE NO. | 600 GRAM DRAINAGE TIME (seconds) |
| Control | 40.0 |
| 1* | 33.8 |
| 1 | 32.4 |
| 2 | 33.7 |
| 3 | 31.0 |
| 4 | 34.9 |

*denotes comparable example

The results clearly show an improvement in drainage efficiency relative to the control. Moreover, drainage efficiency was equivalent to or superior than the comparable example 1.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dry strength additive composition comprising:

an anionic and/or amphoteric polyacrylamide having a molecular weight of less than 500,000 Daltons, wherein the amphoteric polyacrylamide has a net negative charge;

a cationic and/or amphoteric starch; and a cationic non-starch polymer, wherein the composition has an overall net positive charge, wherein the cationic non-starch polymer is selected from the group consisting of: a dimethylamine-epichlorohydrin polymer, a dimethyldiallylammonium chloride homopolymer or copolymer, a polymeric quaternary ammonium compound, and a combination thereof; and wherein the anionic and/or amphoteric polyacrylamide to the cationic starch is at a weight ratio range from 5:1 to 1:2.

2. The dry strength additive composition of claim 1, wherein the anionic and/or amphoteric polyacrylamide, the cationic and/or amphoteric starch, and the cationic non-starch polymer are in the form of a premixed blend.

3. The dry strength additive composition of claim 1, wherein the amphoteric polyacrylamide has a net negative charge of 0.1 to 10 meq/g.

4. The dry strength additive composition of claim 1, wherein the cationic and/or amphoteric starch has a degree of substitution from 0.001 to 0.5%.

5. The dry strength additive composition of claim 1, wherein the anionic and/or amphoteric polyacrylamide to the cationic starch is at a weight ratio range from 2:1 to 1:2.

6. The dry strength additive composition of claim 1, wherein the anionic and/or amphoteric polyacrylamide is at 5 to 90% by weight of the total weight of the composition, the cationic and/or amphoteric starch is at 5 to 90% by weight of the total weight of the composition, and the cationic non-starch polymer is at 3 to 70% by weight of the total weight of the composition.

7. The dry strength additive composition of claim 1, wherein the anionic polyacrylamide is a reaction product of acrylamide and an acrylic acid.

8. The dry strength additive composition of claim 1, wherein the amphoteric polyacrylamide with the net negative charge is a reaction product of acrylamide, a cationic monomer, and an anionic monomer, wherein the anionic and the cationic monomers are less than 90 mol percent of the amphoteric polyacrylamide.

9. The dry strength additive composition of claim 1, wherein the cationic non-starch polymer is a polyamine comprising a reaction product of dimethylamine, ethylene diamines, and epichlorohydrin.

10. The dry strength additive composition of claim 1, wherein the cationic non-starch polymer has a charge density greater than 1 milliequivalents per gram (meq/g) at a pH of 3.

11. A process for increasing dry strength of a paper product, comprising:

adding a composition comprising an anionic and/or amphoteric polyacrylamide having a molecular weight of less than 500,000 Daltons, wherein the amphoteric polyacrylamide has a net negative charge; a cationic and/or amphoteric starch; and a cationic non-starch polymer to a pulp suspension, wherein the composition has an overall net positive charge, wherein the cationic non-starch polymer is selected from the group consisting of: a dimethylamine-epichlorohydrin polymer, a dimethyldiallylammonium chloride homopolymer or copolymer, a polymeric quaternary ammonium compound, and a combination thereof, wherein the anionic and/or amphoteric polyacrylamide to the cationic starch is at a weight ratio range from 5:1 to 1:2; and forming the paper product.

12. The process of claim 11, wherein adding the composition comprises forming a pre-mixed blend of the anionic and/or amphoteric polyacrylamide, the cationic and/or amphoteric starch, and the cationic non-starch polymer; and adding the premixed blend to the pulp suspension.

13. The process of claim 11, wherein the composition is added in an amount of up to 2% based on dry fiber weight of the pulp suspension.

14. The process of claim 11, wherein the cationic and/or amphoteric starch has a degree of substitution from 0.001 to 0.5%.

15. The process of claim 11, wherein the anionic and/or amphoteric polyacrylamide to the cationic starch is at a weight ratio range from 2:1 to 1:2.

16. The process of claim 11, wherein the anionic and/or amphoteric polyacrylamide is at 5 to 90% by weight of the total weight of the composition, the cationic and/or amphoteric starch is at 5 to 90% by weight of the total weight of the composition, and the cationic non-starch polymer is at 3 to 70% by weight of the total weight of the composition.

17. The dry strength additive composition of claim 11, wherein the cationic non-starch polymer has a charge density greater than 1 milliequivalents per gram (meq/g) at a pH of 3.

18. A dry strength additive composition comprising:

an anionic and/or amphoteric polyacrylamide having a molecular weight of less than 500,000 Daltons, wherein the amphoteric polyacrylamide has a net negative charge;

a cationic and/or amphoteric starch; and a cationic non-starch polymer, wherein the cationic non-starch polymer has at least about 1 meq/g quaternary amines, wherein the cationic non-starch polymer is selected from the group consisting of: a dimethylamine-epichlorohydrin polymer, a dimethyldiallylammonium chloride homopolymer or copolymer, a polymeric quaternary ammonium compound, and a combination thereof.

19. The dry strength additive composition of claim 18, wherein the cationic non-starch polymer is selected from the group consisting of: epi-dma polyamines, polyDADMAC, cationic polyacrylamide, and a combination thereof.

20. The dry strength additive composition of claim 18, wherein the cationic non-starch polymer has a charge density greater than 1 milliequivalents per gram (meq/g) at a pH of 3.

* * * * *